US007195529B1

(12) United States Patent
Crandall

(10) Patent No.: US 7,195,529 B1
(45) Date of Patent: Mar. 27, 2007

(54) STRAP CONTAINMENT DEVICE

(75) Inventor: Kevin Crandall, St. Cloud, MN (US)

(73) Assignee: Stearns Inc., Sauk Rapids, MN (US)

( * ) Notice: Subject to any disclaimer, the term of this patent is extended or adjusted under 35 U.S.C. 154(b) by 0 days.

(21) Appl. No.: 11/130,697

(22) Filed: May 17, 2005

(51) Int. Cl.
*B63C 9/08* (2006.01)

(52) U.S. Cl. ..... 441/106

(58) Field of Classification Search ..... 441/106
See application file for complete search history.

(56) References Cited

U.S. PATENT DOCUMENTS

| | | | | |
|---|---|---|---|---|
| 2,065,242 | A * | 12/1936 | Omerly, Jr. | 160/370.21 |
| 4,888,830 | A | 12/1989 | Putnam | |
| 4,999,888 | A | 3/1991 | Miller | |
| 5,293,884 | A | 3/1994 | Chapman et al. | |
| 5,366,072 | A | 11/1994 | Goldenberg | |
| 5,618,110 | A | 4/1997 | Sullivan | |
| 5,887,301 | A | 3/1999 | Anderson | |
| 6,038,748 | A | 3/2000 | Durney et al. | |
| 6,141,805 | A | 11/2000 | Fisher-Cohen et al. | |
| 6,318,612 | B1 | 11/2001 | MacNeil | |
| 6,379,208 | B2 * | 4/2002 | Khanamirian | 441/106 |
| 6,751,816 | B1 | 6/2004 | Wechsler | |
| 6,786,028 | B1 * | 9/2004 | Longtin | 54/79.2 |
| 2004/0000570 | A1 | 1/2004 | Forsman | |
| 2004/0123386 | A1 | 7/2004 | Higashi et al. | |

FOREIGN PATENT DOCUMENTS

| | | |
|---|---|---|
| JP | 2002354636 | 12/2002 |

* cited by examiner

*Primary Examiner*—Stephen Avila
(74) *Attorney, Agent, or Firm*—Merchant & Gould P.C.

(57) ABSTRACT

A strap containment device includes a strap and a loop member. The strap includes an end and a length and is configured to roll upon itself such that the strap end is at a center of a roll of the strap. The loop member is coupled to the strap end and extends in a direction nonparallel to a direction along the strap length. The loop is exposed outside of the roll and is configured to extend around the roll to contain the roll.

20 Claims, 7 Drawing Sheets

STRAP CONTAINMENT DEVICE

BACKGROUND OF THE INVENTION

1. Field of the Invention

The present invention generally relates to devices and systems for containing a structure, and more particularly relates to containment devices for structures such as straps, webbing, cords and the like that require containment of a loose end of the structure.

2. Description of the Prior Art

There are many different applications for straps, webbing members, cords, etc. (referred to as a "strap" herein) in which a free end of the strap remains loose. In one application, a strap is used in combination with a buckle to hold down a car-top carrier on top of a car. The strap may be secured to the carrier and extend through a mounting bracket on top of the car. A buckle is secured to one end of the strap and the opposing end may be passed through the buckle and the strap is cinched tight. The free end of the strap is free to move about under wind forces resulting from the vehicle's motion. This causes the free end to flap about, which may cause the buckle to loosen and result in damage to the carrier or the car. The flapping of the free end can also produce an audible noise that can be heard from the inside of the vehicle. The flapping of the strap can also result in chipping or scuffing of the vehicle's exterior surface and possible fraying or unraveling of the strap material.

In another example, a strap may be part of an adjustable harness for a backpack or webbing for a personal flotation device. The strap may include excess length that is required for adjusting the harness or webbing for different sized users or different sized loads. Adjusting the harness or webbing to a large size using the excess strap length may also make it possible to loosen the harness or webbing for putting on and removing the backpack. The strap is typically secured to the backpack with a fastener such as a buckle that leaves an excess length of the strap dangling free from the buckle. Such a dangling strap may be undesirable to a user for many reasons. Dangling straps may detract from the aesthetic appearance of a pack or flotation device, get undesirably tangled, or strike against a user during use of the backpack or flotation device.

There is a need for a strap management system that addresses these needs and needs in other strap applications.

SUMMARY OF THE INVENTION

The present invention relates to strap containment devices and method of manufacturing and using the same. One aspect of the invention relates to a strap containment device that includes a strap and a loop member. The strap includes an end and a length and is configured to roll upon itself such that the strap end is at a center of a roll of the strap. The loop member is coupled to the strap end and extends in a direction nonparallel to a direction along the strap length. The loop is exposed outside of the roll and configured to extend around the roll to contain the roll.

Another aspect of the invention relates to a personal flotation device that includes an inherently buoyant member, a strap, and a containment member. The strap is coupled to the buoyant member at an attached end of the strap and is configured to roll upon itself such that the strap end is at a center of a roll. The containment member is coupled to a unattached end of the strap and includes a loop of elastic fabric that extends from the strap and is exposed out of the roll. The loop is configured to extend around the roll to contain the roll.

A further aspect of the invention relates to a method of containing a length of strap. The method includes securing a loop of material to an end of the strap so that the loop extends in a direction substantially transverse to a direction along the length of the strap. The method also includes rolling the strap upon itself beginning at the end of the strap and rolling along the length of the strap. The method further includes extending the loop around the rolled up portion of the strap to contain the rolled up portion of the strap. In other embodiments, the strap may be gathered together using other methods besides rolling the strap upon itself. The loop may be useful for containing the strap and constraining movement of the excess length of the strap regardless of what method is used to gather together the loose end of the strap.

The above summary of the present invention is not intended to describe each disclosed embodiment or every implementation of the present invention. The example embodiments described below in relation to the Figures are applicable to many fields to fulfill the purposes and intents of the present invention. Figures in the detailed description that follow more particularly exemplify certain embodiments of the invention. While certain embodiments will be illustrated and describe embodiments of the invention, the invention is not limited to use in such embodiments.

BRIEF DESCRIPTION OF THE DRAWINGS

Referring to the drawing wherein like numerals represent like parts throughout the several views.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention relates to containment devices for structures such as a strap that requires containment of a loose end of the structure. Known structures and methods for containing a loose end of such a structure have many drawbacks related to cost, complexity, reliability, ease of use, and ease of manufacture. Some example structures and methods for containing a loose end of the structure include clips, rigid feed-through loops, and hook and loop straps (e.g., Velcro™ brand straps) that are coupled along the length of the structure, or retaining structures that are coupled to the object to which the structure is secured (e.g., a containment device coupled to a personal flotation device that includes webbing straps). Each of these examples has certain drawbacks that make the design undesirable for at least one reason or another.

An example containment device according to principles of the present invention includes a loop member or some type of loop or partial loop structure. The loop member is configured to extend around the structure to retain the loose end of the structure. A portion of the structure length may be consolidated together using techniques such as rolling, folding, gathering, etc., and the loop member extends around this consolidated portion to contain a desired portion of the structure length.

The structure to be contained includes a flexible or pliable material that can be folded or rolled upon itself to reduce the otherwise loose length of the structure. The entire structure may include the flexible material, or only certain portions of the structure may include the flexible material where bending or folding occurs. The structure may be any elongate member that has a portion that must be contained at some time. Example structures include strap, rope, webbing, cord, cable, string, band, leash, etc. These structures may include any desired material such as, for example, natural materials such as leather or man-made materials such as polymer-based materials.

Figure 1:
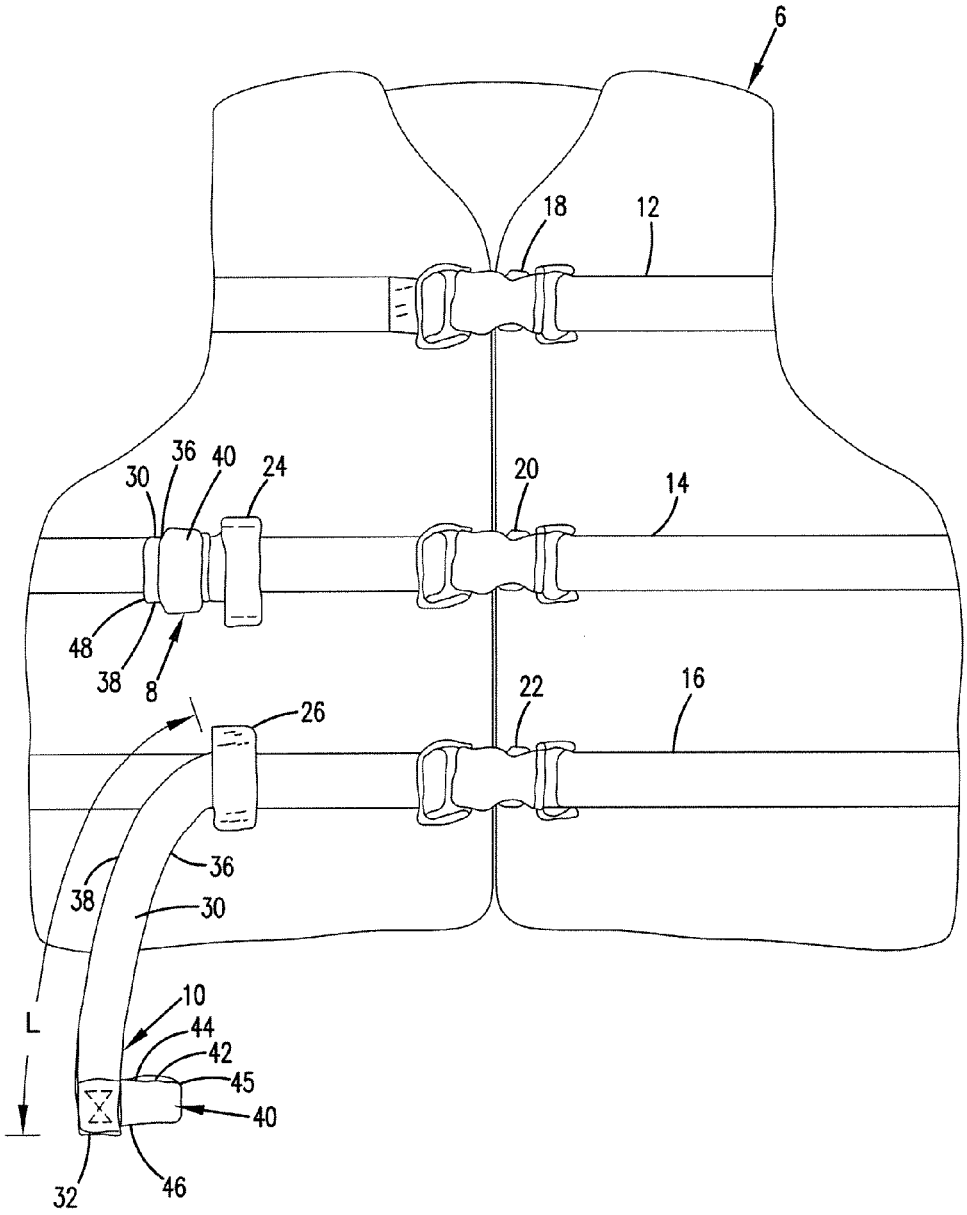
FIG. 1 is a front view of a flotation jacket incorporating example strap containment devices incorporating principles of the invention.

FIG. 1 illustrates an example containment device and an example application for the containment device on a personal flotation device. The personal flotation device 6 includes first, second and third webbing straps 12, 14, 16 that extend around the flotation device 6. Buckles 18, 20, 22 are associated with each of the straps 12, 14, 16, respectively, to help retain the personal flotation device 6 securely in place on a user. The webbing straps 14, 16 are adjustable in length so that the personal flotation device 6 can be adjusted for various user sizes. Strap containment devices 8, 10 are included at an end of each of the respective straps 14, 16.

Each strap containment device 8, 10 includes a loose end portion 30 of the respective strap 14, 16. The strap end 30 includes a distal end 32 (shown only for device 10), a length L (see device 10), and first and second side edges 36, 38. The loose strap portion 30 is contained against the personal flotation device 6 at the point where the strap hold down members 24, 26 (e.g., loops, straps, clips, etc.) are secured to or otherwise retain against the flotation device 6. The length of the loose strap end 30 may vary depending on the adjustment length of the straps 14, 16 as determined by how much of the strap 14, 16 extends between the two sides of the respective buckles 20, 22. The length of the loose strap end 30 may also be influenced by the position of any hold down members 24, 26, if hold down members are present.

A loop member 40 extends in a transverse direction to the direction along the length L of the strap 30. The loop member 40 is coupled near the distal end 32 and is oriented such that the opening 42 of the loop 40 is open in a direction parallel with or may be entered by moving in a direction parallel with the direction along the length L. In other embodiments, the opening 42 may be oriented in any desired direction so long as at least a portion of the loop is exposed outside of a roll of the strap when the strap is rolled upon itself.

The loop member includes first and second ends 44, 46 that are each secured to the strap 30. An opposing distal end 45 of the loop 40 is oriented remote from the strap 30. A length $L_L$ of the loop 30 is measured from a side edge of the strap 30 to the distal end 45 of the loop 30 (see FIG. 4). A total length of exposed loop material $L_{TL}$ is typically determined by multiplying the length $L_L$ by two as follows:

$$L_{LT}=L_L\cdot 2$$

Preferably, the length $L_{TL}$ is less than a circumference of the roll of strap 48 for reasons described in further detail below.

In use, the loose strap end 30 is rolled upon itself to form a roll 48 (see containment device 8). The loop member 40 may be fitted around the roll 48 thereby containing the loose strap end 30. FIG. 1 illustrates the strap containment device 8 in a rolled up and contained state and illustrates the strap containment device 10 in an uncontained state.

Figure 2:
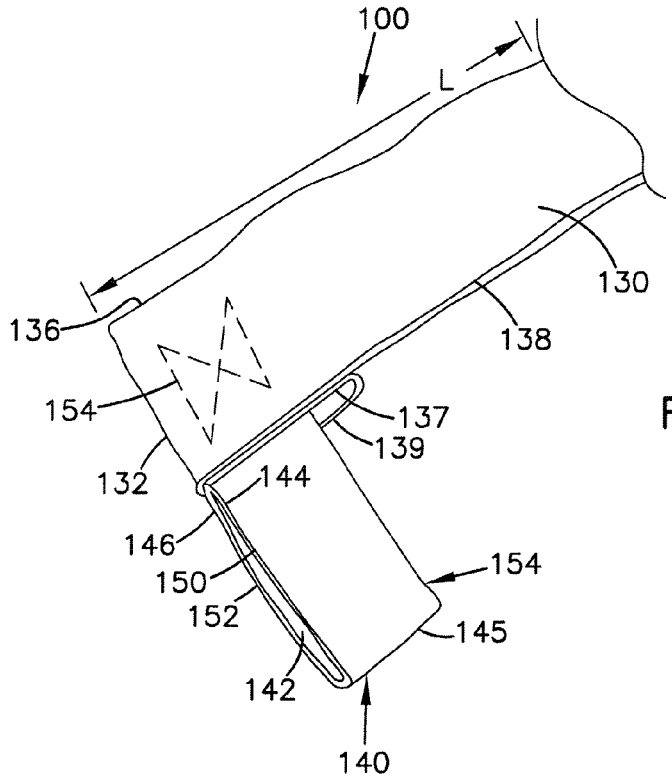
FIG. 2 is top perspective view of an example strap containment device incorporating principles of the invention.
Figure 3:
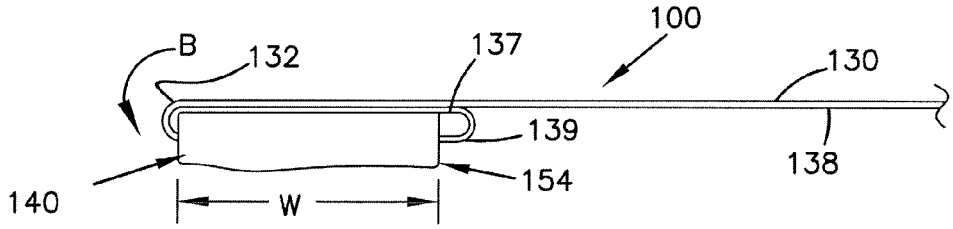
FIG. 3 is a side view of the embodiment shown in FIG. 2.
Figure 4:
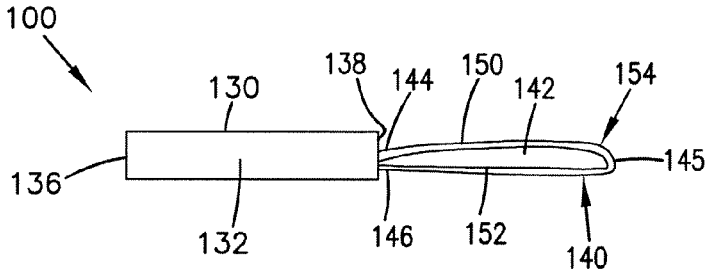
FIG. 4 is an end view of the embodiment shown in FIG. 2.

Referring now to FIGS. 2–4, an example of strap containment device 100 is shown and described. Device 100 includes a loose strap portion 130 having a distal end 132, a length L, first and second side edges 136, 138, and first and second folded layers 137, 139. The loose strap portion 130 represents a loose or free end of a structure such as, for example, a webbing strap, cord, rope, etc. One purpose for the strap containment device 100 is to constrain or confine the loose strap portion 130 in a confined state or in an arrangement in which the loose strap portion 130 is contained and/or restricted from motion.

In order to constrain the loose strap portion 130 as described above, a loop 140 may be secured to the distal end 132 and used to extend around the loose strap portion when the loose strap is gathered together. Example gathering arrangements include rolling, folding, pleating, tucking, flaking, and bunching the loose strap portion 130 into a closely fit mass of strap material. The loop 140 is then extended around the mass of strap material to constrain motion of the loose strap portion 130.

The loop 140 includes first and second portions 150, 152 that are coupled together as a continuous piece of material at a distal end 145 and include first and second inside ends 144, 146 that are secured together at the distal end 132 of the strap portion 130. The first and second portions 150, 152 define an opening 142 when the loop 140 is in a rest state 154 (see FIGS. 2–5).

The first and second ends 144, 146 of the loop 140 are positioned between the folded layers 137, 139 of the strap portion 130. The first and second ends 144, 146 are secured to the strap portion 130 using any desired method or structure for securing. FIG. 2 illustrates a stitching pattern 154 for securing the loop 140 to the strap portion 130. Other means for securing the loop 140 to the strap portion 130 include, for example, rivets, staples, adhesives, fasteners, or any other desired structure or securing method. The stitching pattern shown in FIG. 2 is a "box-x" design. Other known stitching patterns include a "back-stitch", a "shape tack", and a "bar tack" design. In some configurations, a single line of stitching or a plurality of spot stitches in a decorative pattern or at random locations may be used.

The loop 140 may include any desired material that provides the retaining function necessary to retain and constrain the mass of collected strap portion 130 as described above. Some example materials for the loop member include, for example, an elastic material such as rubber, elastomeric plastic, tape elastic, elastic fabric, fabric cut on a true or non-true bias, elastic cord, and combinations of elastic and non-elastic materials.

An example elastic material has an elastic property of about 110% to about 150% stretch factor, more preferably about 120% to about 140% stretch factor, and most preferably about 130% stretch factor. The term "stretch factor" as used to define an elastic property relates to a percentage elastic deformation or percent elongation of the material in a width, length or thickness dimension of the material. For some materials, the percentage stretch may relate to only one or two dimensions of the material. For purposes of describing the loop member in the example embodiments described herein, the percentage stretch and stretch factor in a length dimension is of primary relevance.

The stretch factor of an elastic material may be determined according to the following example test procedures. In a first example, a length of elastic material is arranged extended along its length in a rest state. While a first end of the elastic material is held stationary, the opposing end is stretched in a direction away from the first end until the material stops stretching but before the elastic material begins to fail (referred to as a "maximum stretched state"). The percentage stretch of the material is the length of the elastic material in the maximum stretched rest state divided by the length of material in the rest state.

In a second example test procedure, a loop of elastic material is held with one end of the loop fixed and a second end of the loop coupled to Chatillon® gauge. The Chatillon® gauge applies a 10 lb. force. The percent elongation or stretch factor is determined by again dividing the stretched length of the loop by the loop length in a rest state.

Another example elastic material is a 1 inch wide woven material that comprises about 56% polyester, 32% Nylon, and 11% elastomer. This material has a stretch factor or percent elongation of about 140% (±10%) when stretched by hand and about 135% (±10%) when stretched by a Chatillon® gauge that applies a 10 lb. force. This material also has a modulus of elasticity of about 1.5 (±10%). The modulus of elasticity (e.g., Young's Modulus of Elasticity) of the material is technically the slope of a particular part of a strain curve.

To generate a modulus of elasticity for this example elastic material, half of the loop of material described in the second example test procedure above is stretched using the Chatillon® gauge with a 10 lb. force. A strain graph resulting from the applied 10 lb. force is evaluated and the force required to provide 50% of the total elongation of the material when a 10 lb. force is applied is taken as the modulus of elasticity (e.g., 1.5 lb. (±10%) is when 50% of the total elongation of 140% (±10%) has occurred).

Some elastic properties of a material have a tendency to degrade over time and are subject to the initial tension applied by the operator, it is difficult to apply and measure exact units of force for the purpose of stretching an elastic material a predetermined amount. An important aspect of the loop structure of the present invention relates to the loop providing a pressure force once the loop has been stretched beyond its rest state in order to fit around a roll of strap. The loop must have a total length of material ($L_{TL}$ described above) that is less than the circumference of the roll of strap in order to apply a pressure force. The pressure force applied by the loop to the roll constricts the roll and prevents the roll from unrolling or otherwise disassembling. The amount of pressure force available for a given loop material and configuration affects both the ease of stretching the loop beyond its rest shape and the amount of resultant constriction on the roll of strap. A material that requires less force to stretch (high stretch percentage) the material may provide insufficient pressure force on the roll, which may result in accidental disengagement of the loop from the roll of strap. A material that requires more force to stretch (low stretch percentage) may provide adequate pressure force to the roll of strap but may also lack the necessary stretch capability to extend around certain roll sizes.

In some embodiments, the loop 140 may be sized and include a particular material that fits a certain size of constrained loose strap portion 130. For example, referring to FIGS. 5–9, the loop 140 may be sized to fit a certain number of layers in a roll 148 of the rolled up strap portion 130. In other embodiments, the loop 140 may be sized and comprise certain materials that fit a wide variety of roll sizes for any desired number of layers of strap portion that are being constrained.

Referring now to FIGS. 3 and 5–9, an example of how the strap containment device 100 may be used to constrain the loose strap portion 130 is shown and described. First, the distal end 132 of the strap portion 130 is rolled in a direction B (see FIG. 3) through at least a 180° (a half turn) rotation of motion. Such a rotation and rolling of the distal end 132 reduces the length of the strap at least an amount equal to the width W of the loop 140 (see FIG. 3). By rotating the distal end 132 with the loop 140 through multiple rotations, a roll 148 of strap portion 130 is generated (see FIGS. 5–9). When the roll 148 becomes a desired size or when the desired amount of loose strap portion 130 has been gathered into the roll 148, the loop 140 may be used to constrain the roll 148 and the otherwise loose strap end 130.

Figure 5:
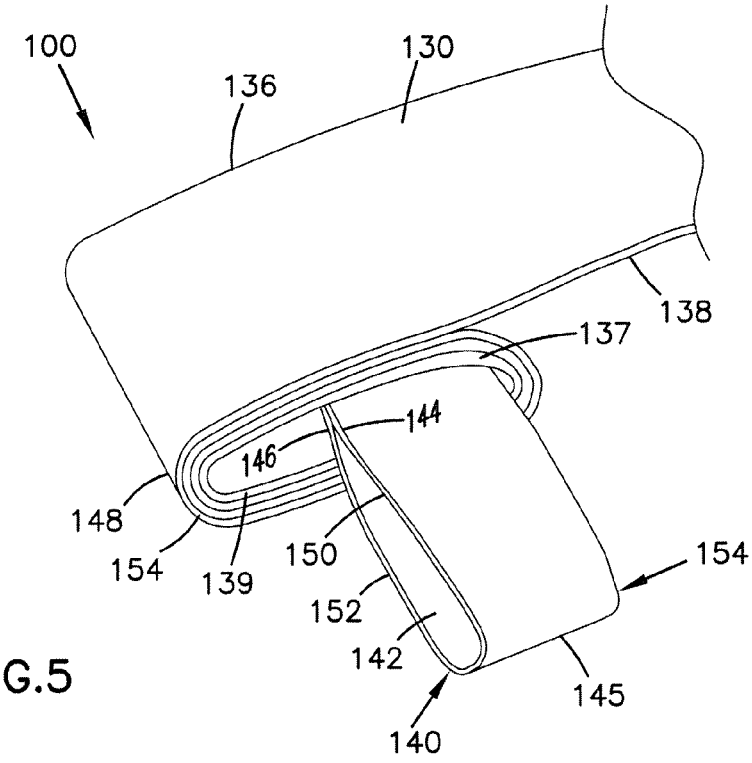
FIG. 5 is a top perspective view of the embodiment shown in FIG. 2 with the strap rolled up and the loop member in a rest state.
Figure 6:
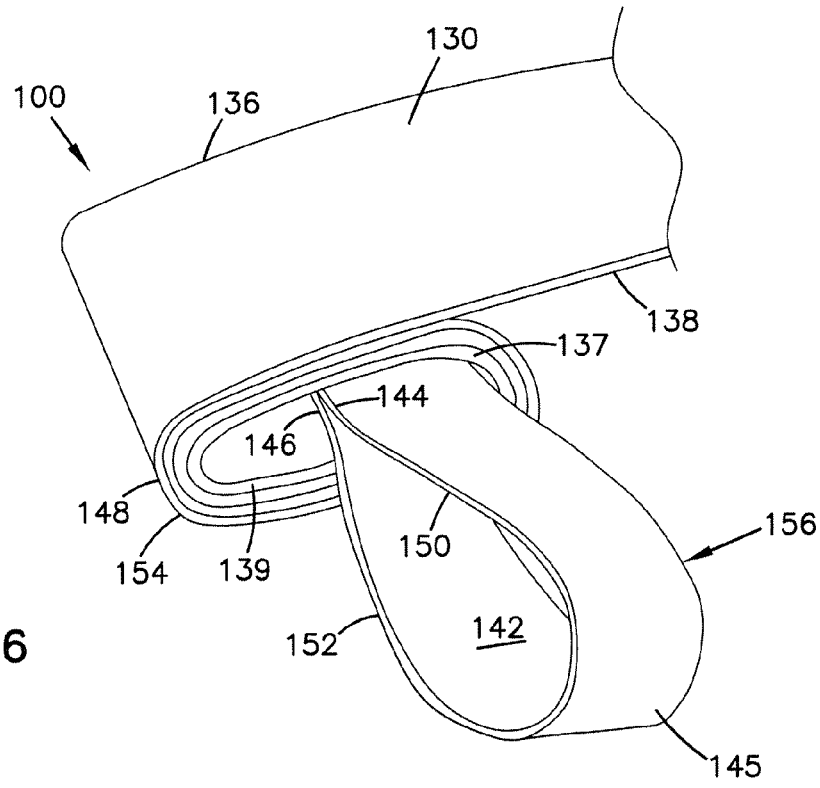
FIG. 6 is a top perspective view of the embodiment shown in FIG. 2 with the strap rolled up and the loop member in a first expanded state.

Referring to FIG. 5, the strap portion 130 is arranged as a roll 148 and the loop 140 is shown in the rest state 154. The rest state represents the loop 140 in an unstretched and undeformed state. In order to extend the loop 140 around the roll 148, the loop 140 is expanded into a first stretched state 156 shown in FIG. 6. For example, a user may stretch the loop to the stretched state using the user's fingers to apply a radially directed pressure to the loop.

Figure 7:
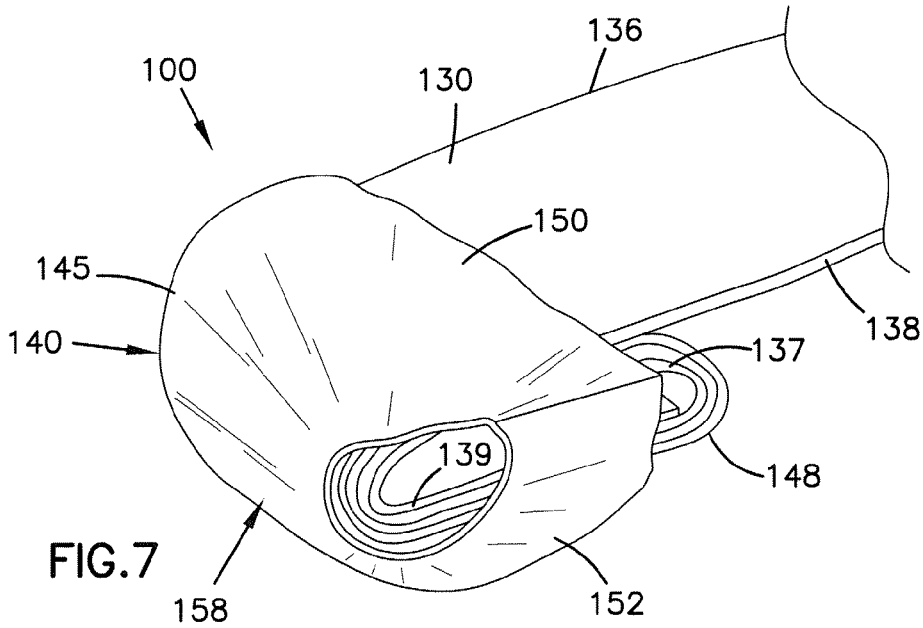
FIG. 7 is a top perspective view of the embodiment shown in FIG. 2 with the strap rolled up and the loop member in an inverted, first expanded state.
Figure 8:
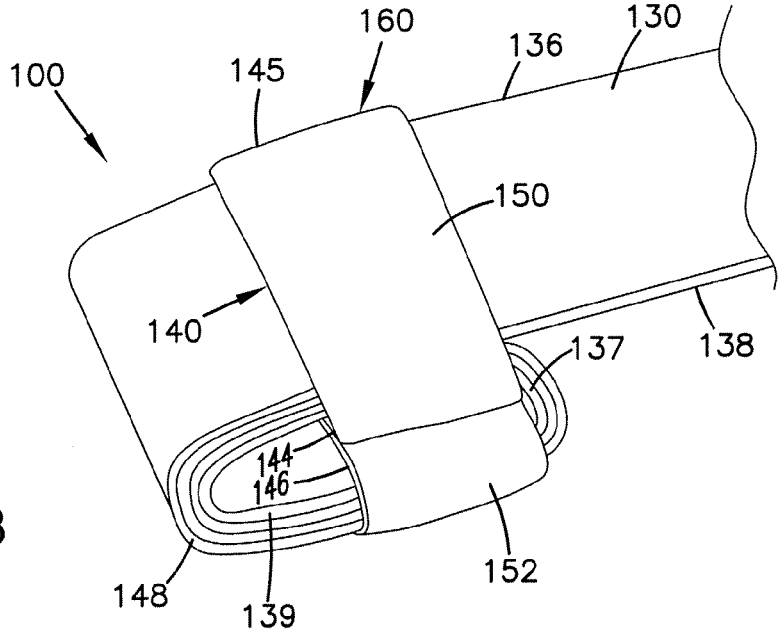
FIG. 8 is a top perspective view of the embodiment shown in FIG. 2 with the strap rolled up and the loop member in an inverted, second expanded state positioned around the rolled up strap.
Figure 9:
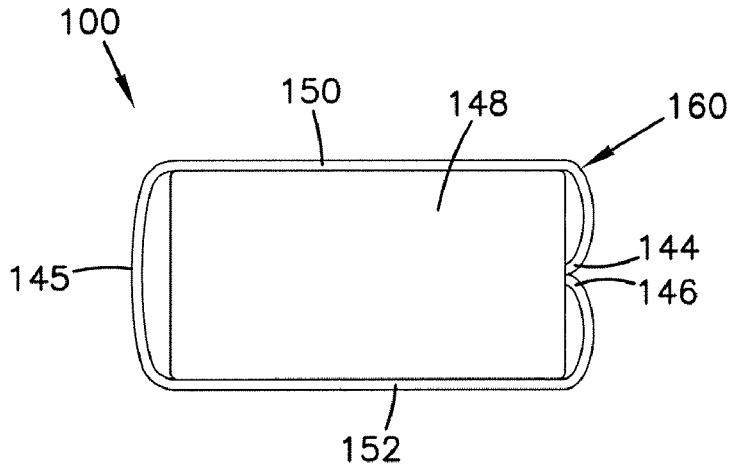
FIG. 9 is an end view of the embodiment shown in FIG. 8.

Next, the loop 140 is moved into an inverted position 158 while still in the first stretch state as shown in FIG. 7. While in the inverted first stretched stated 158, the loop 140 is moved over and around the roll 148 and released on to the roll 148 into an inverted second stretched state 160 (see FIGS. 8 and 9). The loop 140 exerts a biasing force onto the roll 148 when in the inverted second stretched state 160 thereby constraining the roll 148 and keeping the roll 148 from expanding out into a loose strap orientation as shown in FIGS. 2–4.

The loop 140 may have various widths, lengths, material thicknesses, and certain material properties that provide various characteristics and functions for the loop 140 relative to the roll 148. The materials and structure of the strap portion 130 may make it possible to provide different constraining forces for different roll sizes and different strap materials. Each different construction for the containment device 100 may result in different costs and may impact the ease of use and ease of manufacturing the containment device. In most embodiments, the strap containment device 100 provides a relatively simple construction that can be used in a variety of applications. The strap containment device 100 is also relatively easy to use and may be constructed of material that is durable and resistant to failure over a large number cycles of use.

In one example webbing system, a loose webbing member or strap has a length of about 2 to 3 inches (e.g., a length of strap that extends loose beyond a buckle that can be repositioned along the strap length). This "tail" of webbing or strap may be provided for ease of grasping to adjust the belt down and may have a variable length. How much of the tail that is taken up in a roll of the strap is determined by the user.

In one example, the strap has one of the following width dimensions (inches): 0.75, 1, 1.25, 1.5, 1.75, or 2.0. Some example strap thicknesses include 0.02 to about 0.08 inches, and more preferably about 0.04 to about 0.06 inches. The strap thickness may vary depending on the weave structure of the material The length of the loop member in one example is about 1 to 3 inches, and more preferably about 1.5 to about 2 inches, although the length may vary depending on several variables such as the material stretch percentage and the width and thickness of the loop.

Figure 10:
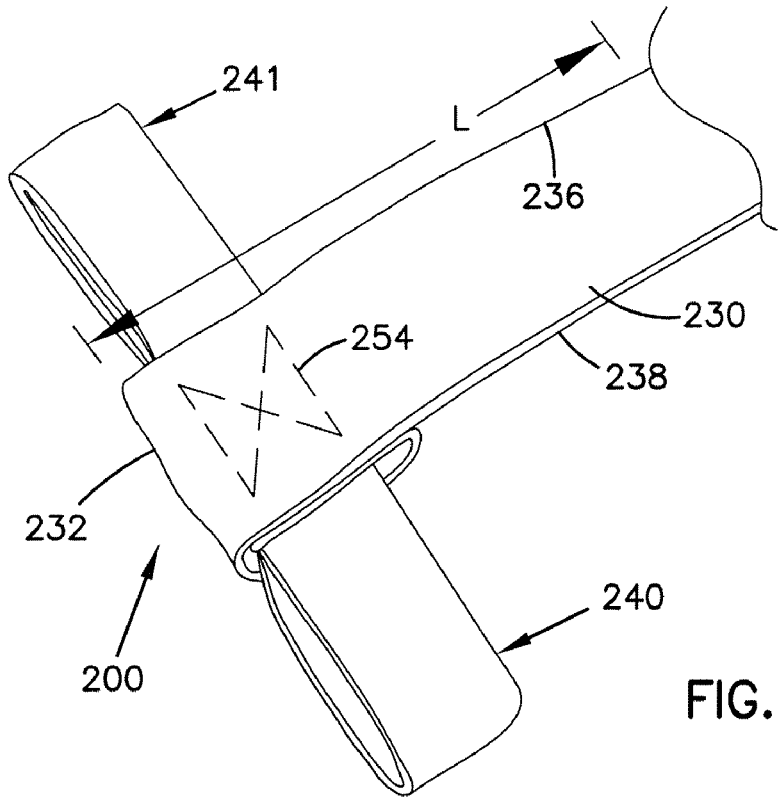
FIG. 10 is a top perspective view of another example strap containment device incorporating two loop members.

Referring now to FIGS. 10–14, several example alternative embodiments are shown and described. FIG. 10 illustrates a strap containment device 200 having a loose strap portion 230 with a distal end 232, a length L, and first and second side edges 236, 238. A pair of loop members 240, 241 extend in a transverse direction from opposite side edges of the strap portion 230. A stitching pattern 254 may be used to secure both loop members 240, 241 to the strap portion 230.

The strap containment device 200 may be useful in applications where a backup loop member is required in the event that one of the loop members fails. In this embodiment, the unused loop member may be folded back over the strap portion 230 at any point when rolling the strap portion into a position where the opposing loop may be stretched over to retain the rolled up portion of the strap with the other loop member inside of the roll. In another embodiment (not shown) the loop members 240, 241 may be positioned along the same side edge of the strap portion 230 in a side-by-side arrangement. Such a side-by-side arrangement may provide the further advantage, in addition to providing a back-up loop, of securing the roll of strap portion 230 with two separate loop members. Securing the roll of strap portion with two loop members may be advantageous for providing additional constraining of the roll and may provide a back-up constraining system. In some embodiments, the two loops have different lengths for use with different roll sizes.

Figure 11:
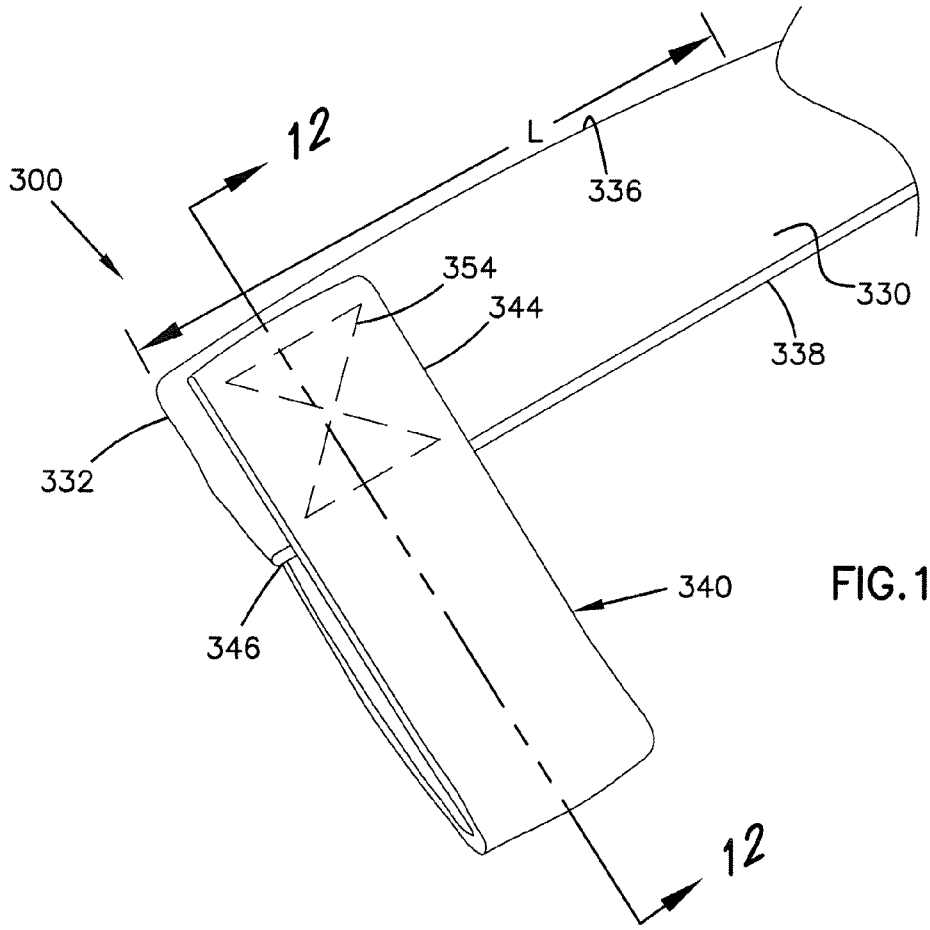
FIG. 11 is a top perspective view of another example strap containment device in which an end of the strap member is positioned between ends of the loop member.
Figure 12:
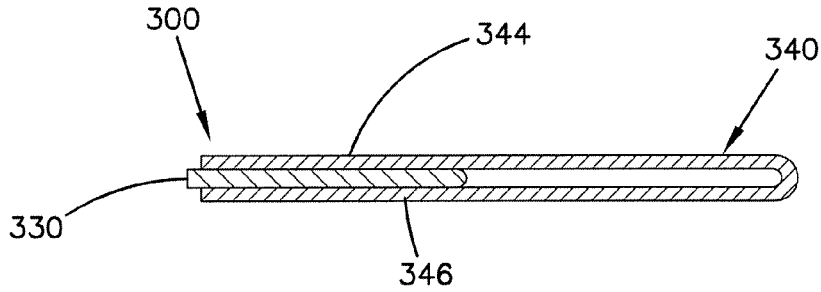
FIG. 12 is a cross-sectional view of the embodiment shown in FIG. 11 taken along indicators 12—12.

Referring now to FIGS. 11 and 12, the strap containing device 300 is shown including a loose strap portion 330 having a distal end 332, a length L, and first and second side edges 336, 338. A loop 340 having first and second inside ends 344, 346 is secured to the distal end 332. The first and second inside ends 344, 346 are positioned on a top and a bottom side, respectively, of the strap portion 330 adjacent to the distal end 332. This arrangement results in the strap portion 330 being "sandwiched" between the ends 344, 346.

The orientation of strap ends 344, 346 may be modified in any desired manner in other embodiments. For example, both of the ends 344, 346 may be positioned on one side surface of the strap portion 330 or both positioned on the opposing side. These concepts may be applied to the strap containment device 100 described above wherein one of the inside ends of the loop is positioned within the folds of the strap portion while the other inside end of the loop is positioned on one or the other of the opposing surfaces of the strap portion. In another variation of the strap containment device 100, the inside ends of the loop may each be positioned between various folds or layers of the loose strap portion if multiple layers of the strap (e.g., 137, 139) are provided.

One reason for the overlapping folds or layers 137, 139 shown with reference to strap containment device 100 is to provide a "T-tab" construction that prohibits the end of the loose strap portion from passing through an adjustment mechanism. An example adjustment mechanism is the buckles 20, 22 for the personal flotation device 6 shown in FIG. 1. A T-Tab structure on an end of the strap is a United States Coast Guard (USCG) requirement for personal flotation devices (PFDs). A strap with a T-Tab is difficult to pass through the adjustor (e.g., buckle 20). The T-Tab includes a loose end of the strap folded in a direction away from the adjustor, thus creating a mass of folded webbing that will jam in the opening into the adjustor through which the strap must travel to pass through the adjuster. Another benefit of the T-Tab construction is that it provides a grabbing surface for adjustment by a user, and it protects the end of the strap from fraying or other types of wear.

Figure 13:
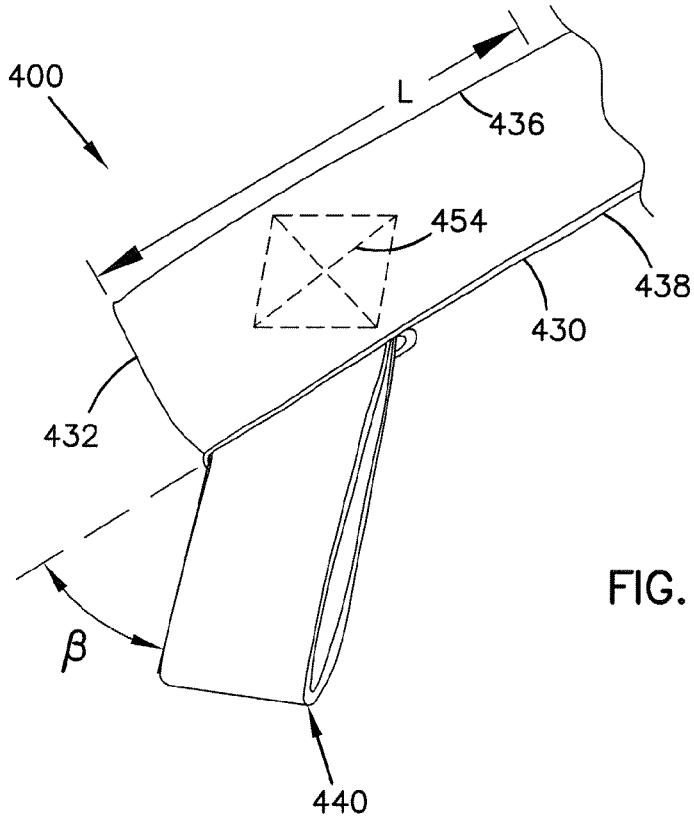
FIG. 13 is a top perspective view of another example strap containment device in which the loop member extends at an angle relative to the direction along the strap length.

Referring now to FIG. 13, a strap containment device 400 is shown including a loose strap portion 430 having a distal end 432, a length L, and first and second side edges 436, 438. A loop 440 may be coupled to the strap portion 430 near the distal end 432. Loop 440 may be secured to the strap portion 430 with a stitching pattern 454. The loop 440 is oriented at an angle β from the direction aligned along the length L of the strap portion 430. The angle β may be greater than 0° and less than 180°. Preferably, the angle β is between about 30° and about 150°, and is more preferably at an angle of about 60° to about 120°.

Figure 14:
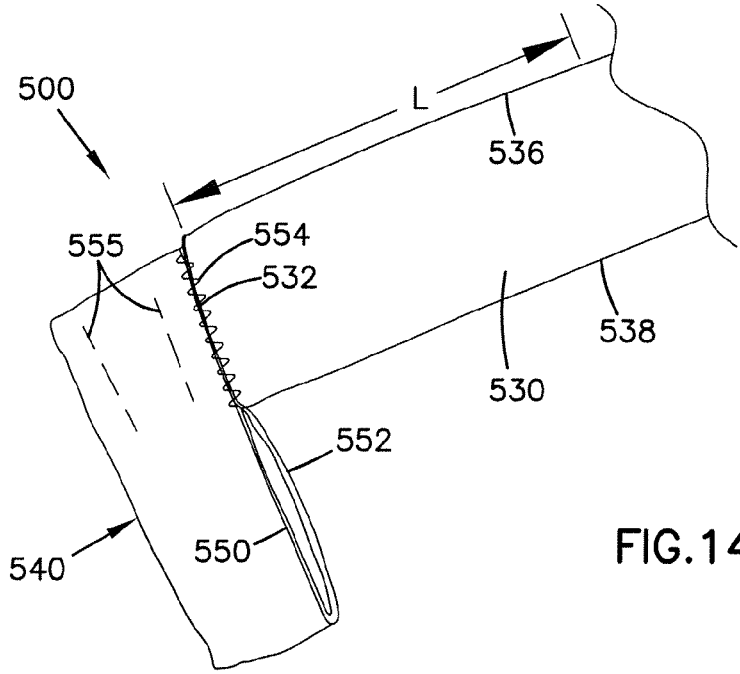
FIG. 14 is a top perspective view of another example strap containment device in which the loop member is secured to and extends from a distal end of the strap.

Referring now to FIG. 14, another example strap containment device 500 is shown and described. Strap containment device 500 includes a loose strap portion 530 having a distal end 532, a length L, and first and second side edges 536, 538. A loop 540 is secured to and extends distally beyond the distal end 532. A stitching pattern 555 may be used to secure first and second layers 550, 552 of the loop together. Another stitching pattern 554 may be used to secure the loop 540 along a side edge of the layers 550, 552 to the distal end 532 of the strap portion 530. Other securing structures or methods may be used besides stitching (see examples provided above) to secure the loop 540 to the strap portion 530.

Although the above description and attached Figures provide specific example embodiments that illustrate principles of the present invention, many other embodiments and configurations are possible. The use of a loop structure that is in some way secured or otherwise attached to a loose end of an elongated structure such as a webbing strap or the like structure for constraining the otherwise loose end of the elongated structure is a primary feature and principle of the present invention. Related methods of using, assembling, and forming a strap containment device or system that includes a loop structure fall within the scope of the present invention.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

I claim:

1. A strap containment device, comprising:

a strap having an end and a length, the strap being configured to roll upon itself such that the strap end is at a center of a roll of the strap, the roll having opposing first and second ends; and a first loop member coupled to the strap end and extending in a direction nonparallel to a direction along the strap length, the loop member being exposed outside of the roll of strap at the first end of the roll and configured to extend around the roll between the first and second ends of the roll to contain the roll.

2. The device of claim 1, wherein the first loop member includes an elastic fabric material.

3. The device of claim 1, wherein the first loop member defines a loop opening having a first, unstretched opening size and a second, stretched opening size.

4. The device of claim 1, wherein the first loop member is configured for use with at least two different rolls sizes of the strap.

5. The device of claim 1, wherein the nonparallel direction includes an angle between about 60° to about 120° to the direction along the strap length.

6. The device of claim 1, further comprising a second loop member coupled to the strap end and extending in a direction nonparallel to the direction along the strap length, wherein the second strap member extends from an opposite side of the strap from where the first loop member extends.

7. A personal flotation device, comprising:

an inherently buoyant member;

a strap coupled to the buoyant member at an attached end of the strap, the strap being configured to roll upon itself such that the strap end is at a center of a roll of the strap, the roll having opposing first and second ends;

a containment member coupled to a unattached end of the strap, the containment member including a loop of elastic fabric that extends from the strap and is exposed out of the roll of strap at the first end of the roll, the loop being configured to extend around the roll between the first and second ends of the roll to contain the roll.

8. The device of claim 7, wherein the loop defines a loop opening when in a rest state, the loop opening being aligned substantially parallel with the length of the strap.

9. The device of claim 7, wherein the loop extends from a side edge of the strap.

10. The device of claim 9, wherein the loop is secured to the side edge of the strap.

11. The device of claim 7, wherein at least a portion of the loop extends distally beyond the unattached end of the strap before the strap is rolled upon itself.

12. The device of claim 7, wherein the elastic fabric has a elastic deformation property of about 120% to about 140% stretch factor.

13. A method of containing a length of strap, the method comprising the steps of:

securing a loop of material to an end of the strap, the loop extending in a direction substantially transverse to a direction along the length of the strap;

rolling the strap upon itself beginning at the end of the strap and rolling along the length of the strap, the rolled up portion of the strap having opposing first and second ends; and extending the loop around the rolled up portion of the strap between the first and second ends of the rolled up portion of the strap to contain the rolled up portion of the strap.

14. The method of claim 13, wherein extending the loop includes stretching the loop material.

15. The method of claim 13, wherein extending the loop includes inverting at least a portion of the loop.

16. The method of claim 13, wherein the loop comprises an elastic fabric material.

17. The method of claim 13, wherein the loop is expandable to extend around at least two different sizes of rolled up strap.

18. The method of claim 13, wherein securing the loop of material includes sewing the loop of material to the strap.

19. The method of claim 13, wherein securing the loop of material includes adhering the loop of material to the strap with adhesives.

20. The method of claim 13, wherein securing the loop of material includes positioning a portion of the loop of material between at least two layers of the strap.

* * * * *